US008162422B2

(12) United States Patent
Kim

(10) Patent No.: US 8,162,422 B2
(45) Date of Patent: Apr. 24, 2012

(54) REFRIGERATOR

(75) Inventor: Seong Wook Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 233 days.

(21) Appl. No.: 12/634,553

(22) Filed: Dec. 9, 2009

(65) Prior Publication Data

US 2010/0175419 A1 Jul. 15, 2010

Related U.S. Application Data

(60) Provisional application No. 61/145,056, filed on Jan. 15, 2009.

(51) Int. Cl.
*A47B 96/04* (2006.01)

(52) U.S. Cl. ..... 312/402; 312/404; 312/301

(58) Field of Classification Search ..... 312/402, 312/404, 330.1, 298, 301, 333
See application file for complete search history.

(56) References Cited

U.S. PATENT DOCUMENTS

| | | | | |
|---|---|---|---|---|
| 2,711,944 | A * | 6/1955 | Meek et al. | 312/333 |
| 4,285,559 | A * | 8/1981 | Koch | 312/298 |
| 5,044,059 | A * | 9/1991 | De Giulio | 29/401.1 |
| 7,261,385 | B2 * | 8/2007 | Weinberger | 312/330.1 |
| 7,467,834 | B2 * | 12/2008 | Kim et al. | 312/402 |
| 7,740,331 | B2 * | 6/2010 | Koo | 312/404 |
| 7,744,173 | B2 * | 6/2010 | Maglinger et al. | 312/333 |
| 7,950,754 | B2 * | 5/2011 | Brown et al. | 312/402 |
| 2006/0175842 | A1 * | 8/2006 | Saitoh et al. | 292/251.5 |
| 2007/0018548 | A1 * | 1/2007 | Ertz et al. | 312/402 |
| 2007/0245762 | A1 * | 10/2007 | Maglinger et al. | 62/344 |
| 2007/0262686 | A1 * | 11/2007 | Ji | 312/402 |
| 2008/0203878 | A1 * | 8/2008 | Lim et al. | 312/405.1 |
| 2010/0175419 | A1 * | 7/2010 | Kim | 62/449 |
| 2010/0219730 | A1 * | 9/2010 | Watts et al. | 312/404 |
| 2011/0006655 | A1 * | 1/2011 | Seo et al. | 312/402 |
| 2011/0006656 | A1 * | 1/2011 | Nam et al. | 312/404 |

* cited by examiner

*Primary Examiner* — Darnell Jayne
*Assistant Examiner* — Daniel Rohrhoff
(74) *Attorney, Agent, or Firm* — Birch, Stewart, Kolasch & Birch, LLP

(57) ABSTRACT

Provided is a refrigerator including a plurality of drawers that partitions a space of a storage chamber and can be selectively withdrawn. In this refrigerator, a user can efficiently utilize the storage space of the storage chamber, and a desired drawer can be opened to easily store and dispense foods.

7 Claims, 8 Drawing Sheets

REFRIGERATOR

This Non-Provisional application claims priority under 35 U.S.C. 119(e) on U.S. Provisional Application No. 61/145,056, filed on Jan. 15, 2009, the entire contents of which are hereby incorporated by reference.

BACKGROUND

Embodiments relate to refrigerator.

Generally, a refrigerator includes a plurality of storage compartments for receiving foods to store the foods in freezing or refrigeration state. One surface of each of the storage compartments is opened to receive and dispense the foods.

A door selectively covering the storage compartment is provided in a front direction of the storage compartment. A storage box for storing the foods may be provided inside the door.

DETAILED DESCRIPTION OF THE EMBODIMENTS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
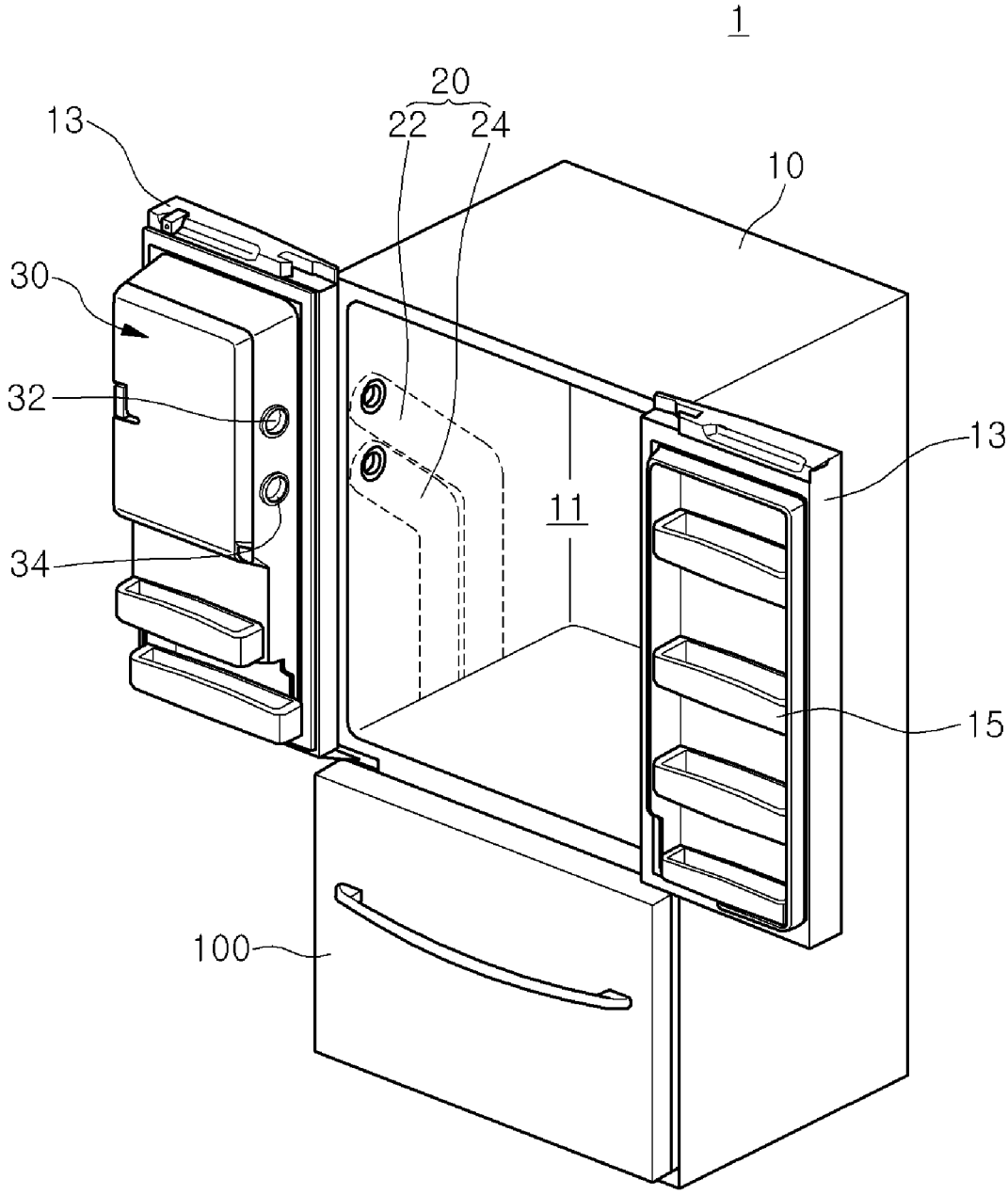
FIG. 1 is a perspective view of a refrigerator according to an embodiment.

FIG. 1 is a perspective view of a refrigerator according to an embodiment.

Referring to FIG. 1, a refrigerator 1 according to this embodiment includes a main body 10 defining a refrigerator compartment 11 and a freezer compartment and having an opened front surface and doors 13 and 100 provided on the front surface of the main body 10 and rotatably coupled to the main body 10.

The doors 13 and 100 include a refrigerator compartment door 13 for selectively covering the refrigerator compartment 11 and a freezer compartment door 100 for selectively covering the freezer compartment. Here, the refrigerator compartment door 13 is provided on an upper portion of the main body 10, and the freezer compartment door 100 is provided on a lower portion of the main body 10.

A bottom freezer type refrigerator in which a freezer compartment is disposed under a refrigerator compartment is described in this embodiment as an example. However, the present disclosure is not limited to this embodiment. For example, a refrigerator according to this embodiment may be applied to following various refrigerators: a top mount type refrigerator in which a refrigerator compartment is disposed under a freezer compartment; and a side by side type refrigerator in which a refrigerator compartment and a freezer compartment are disposed in left and right sides, respectively.

In detail, the refrigerator compartment door 13 is provided in plurality at both upper sides of the main body 10 and rotatably coupled with respect to both ends of the main body 10. Here, a hinge shaft (not shown) that defines a rotation center may be inserted in a side of the refrigerator compartment door 13.

The freezer compartment door 100 is coupled to a lower portion of the main body 10. The freezer compartment door 14 may have a drawer-type shape and be withdrawable to the outside.

An ice-making device 30 that makes ice using supplied water is provided on a back surface of the refrigerator compartment door 13. The ice-making device 30 includes a cool air supply part 32 and a cool air exhaust part 34 through which the cool air is supplied or exhausted into/from the freezer compartment.

A cool air duct 20 through which the cool air flows is provided inside a surface of main body 10. The cool air duct 20 includes a supply duct 22 through which the cool air is supplied into the cool air supply part 32 and an exhaust duct 24 through which the cool air exhausted from the cool air exhaust part 34 flows.

One side of the supply duct 22 and one side of the exhaust duct 24 are connected to one side of the freezer compartment. At least portion of the cool air generated by an evaporator is supplied into the ice-making device 30 through the supply duct 22. The cool air circulating in the ice-making device 30 is exhausted through the exhaust duct 24, and then may be introduced into the freezer compartment.

A plurality of door baskets 15 for receiving the foods may be provided on the back surface of the refrigerator compartment door 13. The plurality of door baskets 15 may be disposed spaced from each other along a length direction of the door 13. Hereinafter, configurations of the freezer compartment and the freezer compartment door 100 will be described with reference to accompanying drawings.

Figure 2:
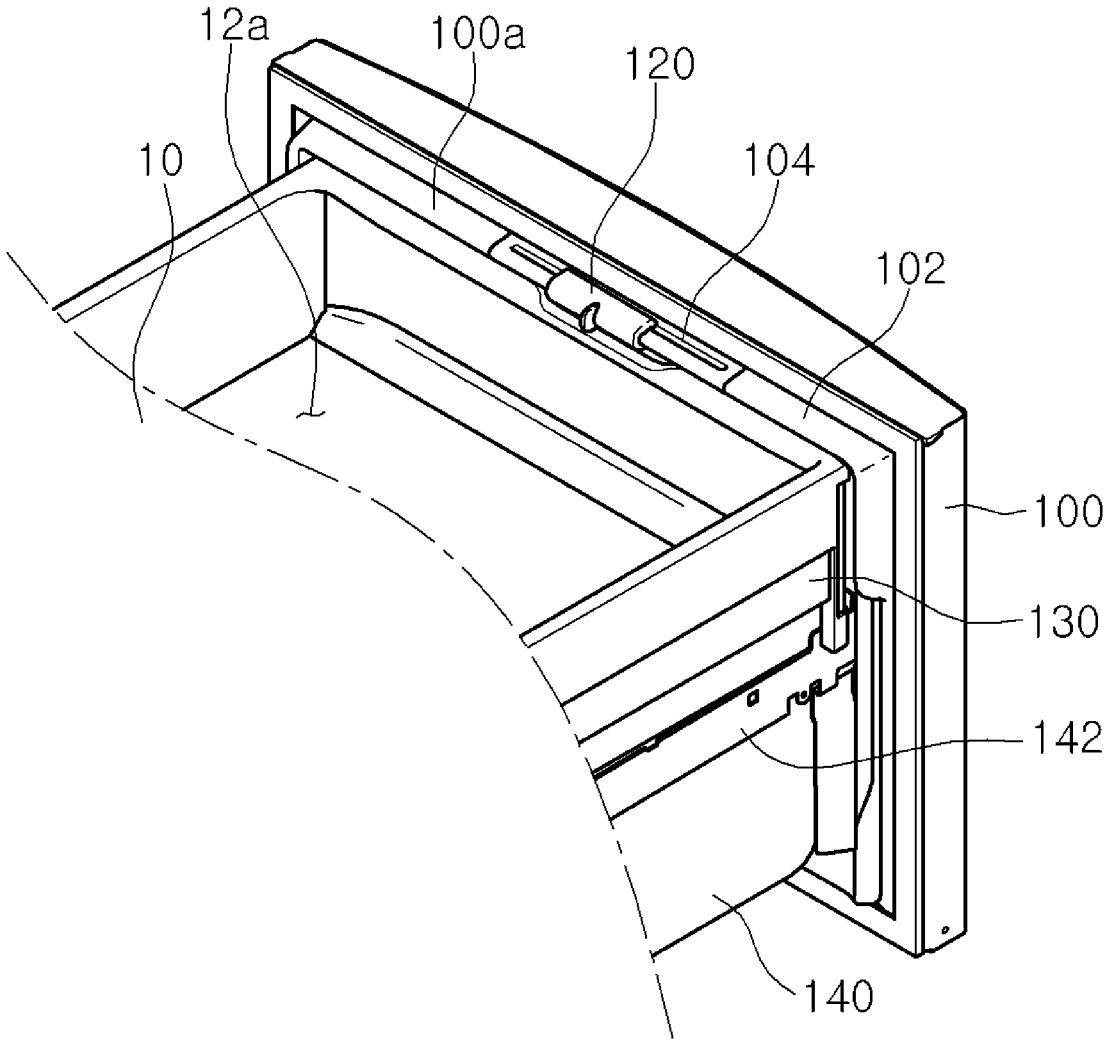
FIG. 2 is a perspective view of one state in which a refrigerator door is opened according to an embodiment.
Figure 3:
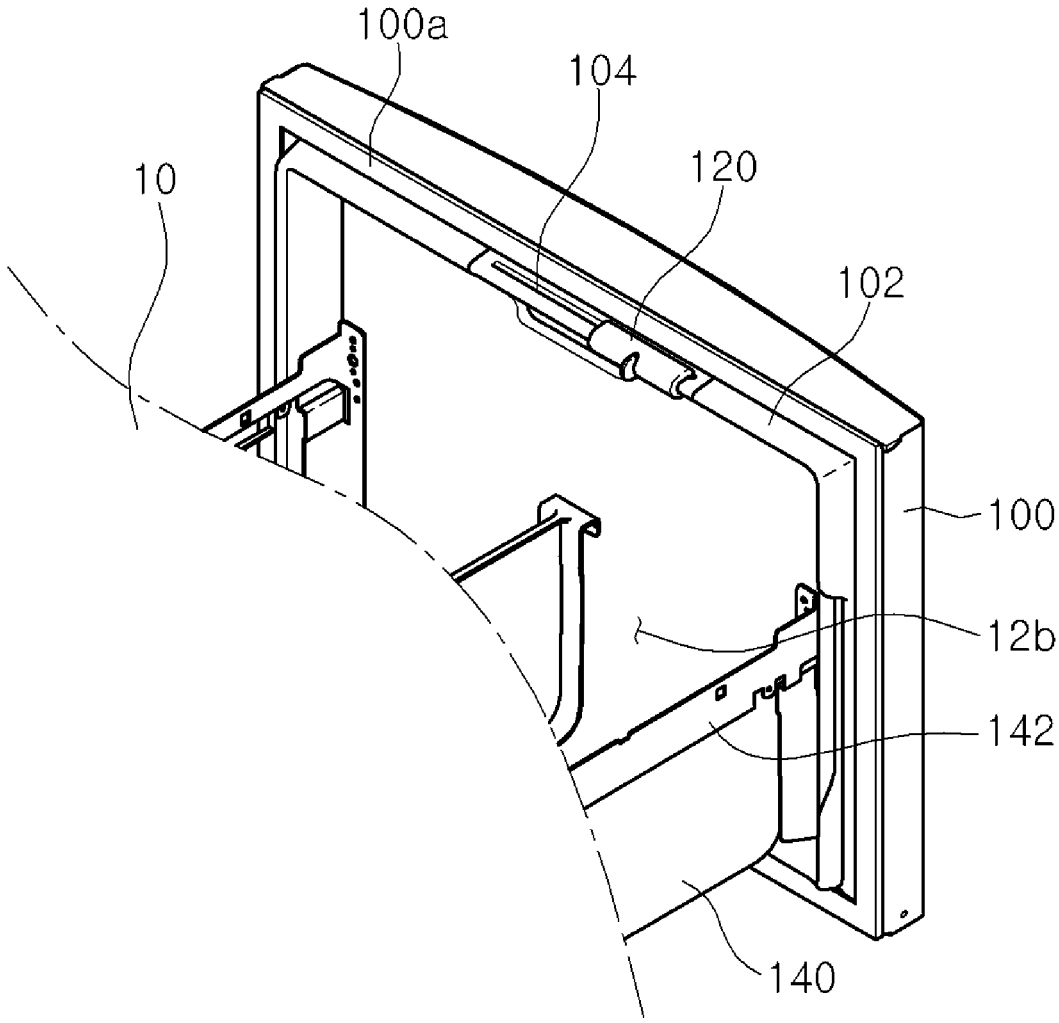
FIG. 3 is a perspective view of the other state in which a refrigerator door is opened according to an embodiment.

FIG. 2 is a perspective view of one state in which a refrigerator door is opened according to an embodiment, and FIG. 3 is a perspective view of the other state in which a refrigerator door is opened according to an embodiment.

Referring to FIGS. 2 and 3, a freezer compartment door 100 according to this embodiment includes a door frame 102 defining an outer appearance of a rear surface of the freezer compartment door 100 and a manipulation member 120 moveably provided on the door frame 102.

The door frame 102 is disposed on an upper portion of a back surface 100*a* of the freezer compartment door 100 and may be horizontally disposed.

A guide groove 104 for guiding a movement of the manipulation member 120 is disposed in the door frame 102. The guide groove 104 is depressed from a top surface and a bottom surface of the door frame 102.

A plurality of drawers 130 and 140 withdrawable in front direction is provided in the freezer compartment. The drawers 130 and 140 are divided into an upper drawer 130 defining an upper storage space 12*a* of the freezer compartment and a lower drawer 140 defining a lower storage space 12*b*.

In a state where the drawers 130 and 140 are inserted, the upper storage space 12*a* and the lower storage space 12*b* define the freezer compartment.

The lower drawer 140 is coupled to the rear surface of the freezer compartment door 100. When the freezer compartment door 100 is inserted or withdrawn, the lower drawer 140 is inserted or withdrawn together with the freezer compartment door 100.

A movement guide 142 for guiding the insertion or withdrawal of the lower drawer 140 is provided on at least side of the lower drawer 140. The movement guide 142 may be movable along a guide rail (not shown) provided inside the main body 10. That is, the lower drawer 140 may be easily inserted or withdrawn due to the guide of the guide rail.

The upper drawer 130 may be selectively coupled to the refrigerator door 100 according to the manipulation of the manipulation member 120.

FIG. 2 is a view of a state in which the upper drawer 130 is coupled to the refrigerator door 100, and thus, the upper drawer 130 is withdrawn forwardly together with the refrigerator door 100. FIG. 2 is a view of a state in which the upper drawer 130 is separated from the refrigerator door 100, and thus, only the refrigerator door 100 is withdrawn forwardly.

Hereinafter, configurations of the manipulation member 120 and the upper drawer 130 will be described with reference to accompanying drawings.

Figure 4:
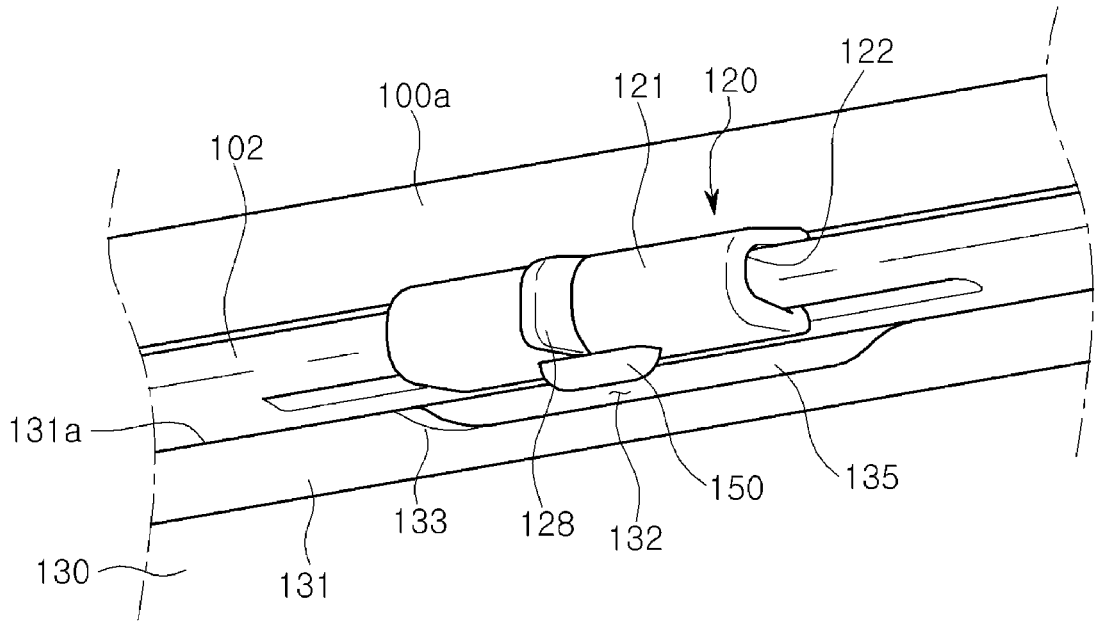
FIG. 4 is a perspective view of an upper drawer hooked on a manipulation member according to an embodiment.
Figure 5:
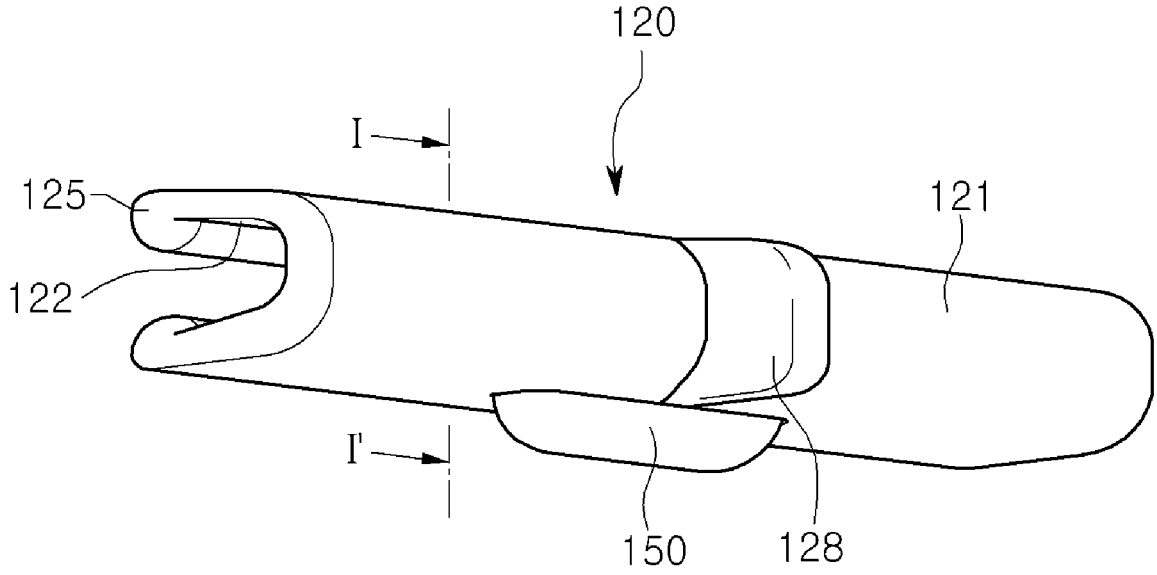
FIG. 5 is a perspective view of a configuration of a manipulation member according to an embodiment.
Figure 6:
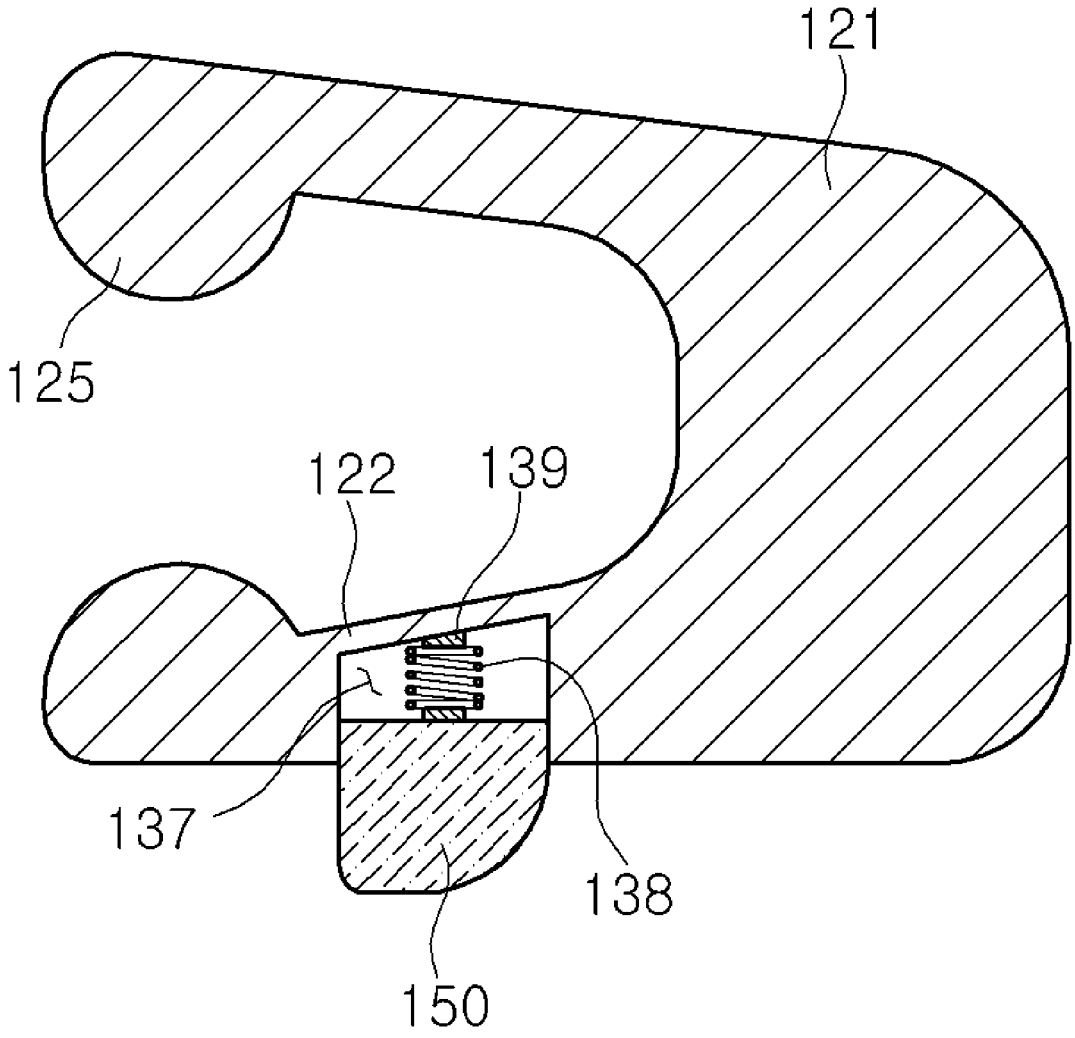
FIG. 6 is a cross-sectional view taken along line I-I' of FIG. 5.

FIG. 4 is a perspective view of an upper drawer hooked on a manipulation member according to an embodiment, and FIG. 5 is a perspective view of a configuration of a manipulation member according to an embodiment. FIG. 6 is a cross-sectional view taken along line I-I' of FIG. 5.

Referring to FIGS. 4 to 6, the manipulation member 120 according to this embodiment is moveable along an outer surface of the door frame 102. When the manipulation member 120 is moved, the upper drawer 130 is selectively hooked on the manipulation member 120.

In detail, the upper drawer 130 includes an upper end frame 131 defining an upper end portion of the upper drawer 130 and a hook jaw 135 extending upwardly from the upper end frame 131 and hooked on the manipulation member 120.

The upper end frame 131 includes a depression portion 132 depressed downwardly by a predetermined distance and a plurality of inclined surfaces 133 inclined in both side directions of the depression portion 132.

Since the depression portion 132 is disposed at an approximately central portion of the upper end frame 131, the upper end frame 131 has a shape depressed from both side portions of the upper end frame 131 toward the central portion. The inclined surfaces 133 extend from both side portions 131*a* of the upper end frame 131 to the depression portion 132. Each of the inclined surfaces 133 has a downwardly inclined shape.

Here, the both side portions 131*a* denote portions that are disposed at both sides of the depression portion 132 and have flat upper surfaces, respectively.

The hook jaw 135 is disposed on a front surface portion of the upper frame 131. In further detail, the hook jaw 135 is disposed in a front direction of the depression portion 132 and extends upwardly from a lower end of the depression portion 132. In other words, the hook jaw 135 connects the plurality of inclined surfaces 133 to each other.

The guide groove 104 is disposed in a top surface of the door frame 102. The guide groove 104 receives at least portion of the manipulation member 120 to guide the movement of the manipulation member 120.

The manipulation member 120 may be moveable horizontally along the guide groove 104. The manipulation member 120 includes a body part 121 defining a body thereof, a handle 128 protruding from a side of the body part 121, and a hook protrusion 150 hooked with the upper drawer 130.

The body part 121 has an approximately U-shape. A rear surface of the body part 121 is depressingly rounded toward a front surface. A guide protrusion 125 moveably inserted into the guide groove 104 is disposed on the body part 121. The guide protrusion 125 may be provided in plurality and inserted into the top surface and the bottom surface of the door frame 102.

A receiving part 122 for receiving the door frame 102 in a state where the body part 121 is coupled to the door frame 102 is disposed on an inner surface of the body part 121. That is, the receiving part 122 surrounds the door frame 102.

The manipulable handle 128 is provided on a front surface of the body part 121. The user can move the handle 128 in left and right directions in a state where the user grasps the handle 128.

The hook protrusion 150 capable of being hooked with the upper drawer 130 is provided on a lower portion of the body part 121.

The hook protrusion 150 may be movable in upward and downward directions. For this, a movement space 137 having a predetermined size is defined inside the body part 121 to allow the hook protrusion 150 to be moved therein.

As described in FIG. 6, the hook protrusion 150 is elastically supported to a side of the receiving part 122 by an elastic member 138. In other words, the elastic member 138 is disposed inside the movement space 138 and connects the hook protrusion 150 to the body part 121.

Although not shown, a plurality of elastic members 138 may be provided on an upper side of the hook protrusion 150.

Coupling parts 139 for coupling the elastic member 138 to the receiving part 122 and the hook protrusion 150 are provided on both sides of the elastic member 138.

In a state where the elastic member 138 is tensioned, the hook protrusion 150 may protrude downwardly from the body part 121 to hook the hook protrusion 150 on the upper drawer 130. In a state where the elastic member 138 is compressed, the hook protrusion 150 is moved inside the movement space 137 to release the hook protrusion 150 from the upper drawer 130.

Figure 7:
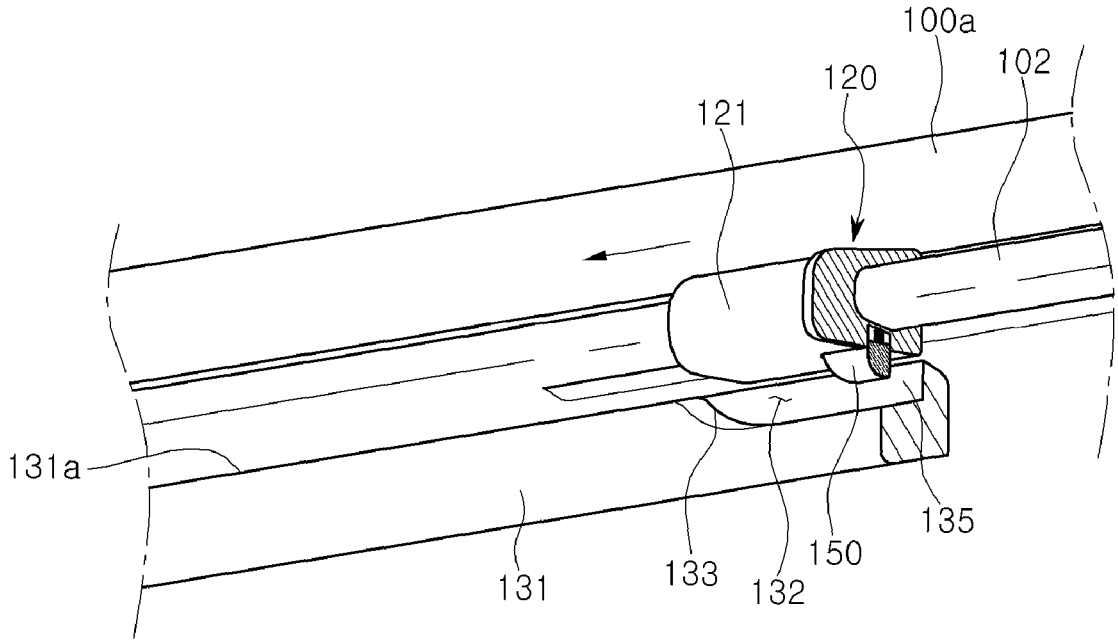
FIGS. 7 and 8 are cross-sectional views illustrating an operation of a manipulation member according to an embodiment.
Figure 8:
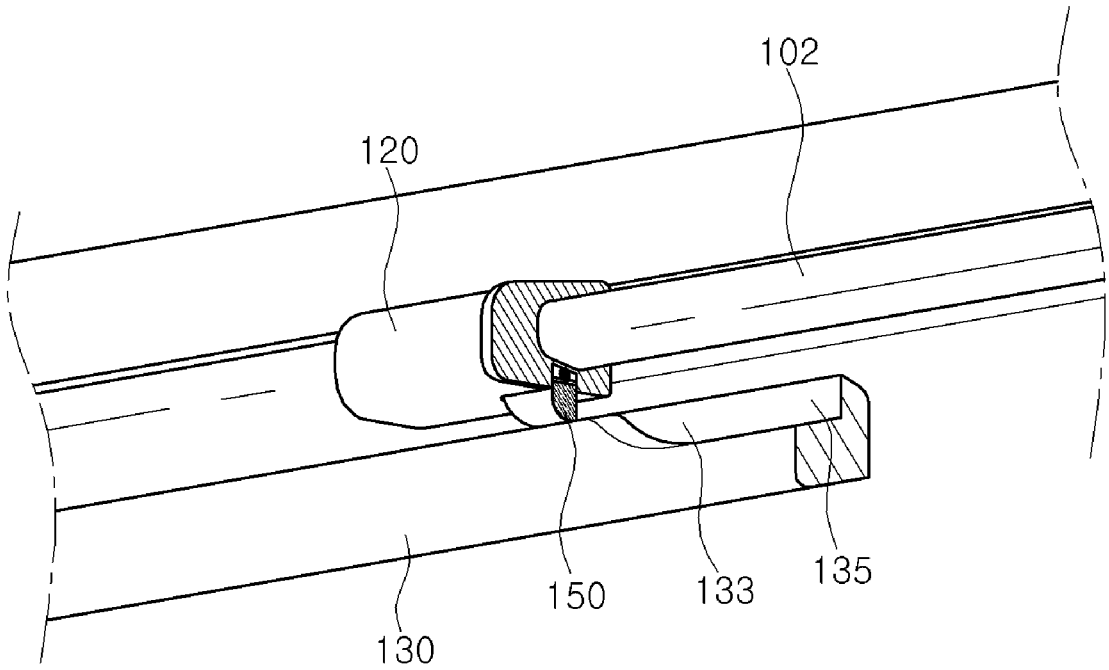

FIGS. 7 and 8 are cross-sectional views illustrating an operation of a manipulation member according to an embodiment.

Referring to FIGS. 7 and 8, the hook and the release between the upper drawer 130 and the refrigerator door 100 according to the movement of the manipulation member 120 will be described.

FIG. 7 is a view of a state in which the refrigerator door 100 and the upper drawer 130 are hooked with each other. In detail, the upper drawer 130 is hooked on the refrigerator door 100 when the hook protrusion 150 is disposed in a rear direction of the hook jaw 135.

At this time, the depression portion 132 is disposed on a lower side of the manipulation member 120, and the hook protrusion 150 interferences with a rear surface of the hook jaw 135 in a state where the hook protrusion 150 protrudes downwardly. Thus, a rear movement of the upper drawer 130 is limited by the hook protrusion 150, and it is maintained in a state where the upper drawer 130 is coupled to the refrigerator door 100.

In this state, the upper drawer 130 and the refrigerator door 100 may be integrally movable. Thus, in case where the user pulls out the foods stored in the upper drawer 130, i.e., in case where the user withdraws the upper drawer 130, the manipulation member 120 is moved to position the manipulation member 120 at an upper side of the depression portion 132, thereby withdrawing the refrigerator door 100 (See FIG. 2).

FIG. 8 is a view of a state in which a hook between the refrigerator door 100 and the upper drawer 130 is released. In detail, when the manipulation member 120 is moved in both side directions of the depression portion 132, the upper drawer 130 may be released from the refrigerator door 100.

In a state where the manipulation member 120 is disposed at a position as shown in FIG. 7, when the manipulation member 120 is moved in the left or right direction, the hook protrusion 150 is moved in the both side portions 131*a* of the upper frame 131 along the inclined surface 133.

Although the manipulation member 120 is moved in the left direction to release the hook thereof in FIG. 8, but the manipulation member 120 may be moved in the right direction to release the hook thereof.

In this process, the elastic member 138 is compressed, and the hook protrusion 150 is moved in an upper direction, i.e., toward the movement space 137.

When a bottom surface of the hook protrusion 150 is disposed on top surfaces of the both side portions 131*a*, the hook protrusion 150 is released from the hook jaw 135. Then, the upper drawer 130 may be released from the refrigerator door 100.

Thus, in case where the user pulls out the foods stored in the lower drawer 140, i.e., in case where the user withdraws the lower drawer 140, the manipulation member 120 is moved to position the manipulation member 120 at an upper side of the both side portions 131*a*, thereby withdrawing the refrigerator door 100.

As a result, only the lower drawer 140 is withdrawn without withdrawing the upper drawer 130. Thus, since the storage space 12*b* of the lower drawer 140 is opened, the foods stored in the lower drawer 140 can be withdrawn (See FIG. 3).

According to the above-described constitutions, since the user can selectively open the upper drawer or the lower drawer by manipulating the manipulation member, the foods can be easily dispensed and stored.

Also, since the plurality of drawers is provided in the freezer compartment, the storage space of the freezer compartment can be efficiently utilized.

What is claimed is:

1. A refrigerator comprising:

a body having a cooling compartment;

a door closing the cooling compartment and linearly movable with respect to the body;

a drawer disposed in the cooling compartment;

a guide portion provided at the inner surface of the door; and a manipulation member engaging the guide portion and slidable along the guide portion between a first position and a second position, wherein the drawer is coupled to the door when the manipulation member is in the first position and uncoupled from the door when the manipulation member is in the second position, wherein the guide portion has a groove, and wherein the manipulation member is U-shaped, an edge of the manipulation member having a protrusion, the protrusion engaging the groove.

2. The refrigerator of claim 1, wherein the guide portion is a door frame.

3. A refrigerator comprising:

a body having a cooling compartment;

a door closing the cooling compartment and linearly movable with respect to the body;

a drawer disposed in the cooling compartment;

a guide portion provided at the inner surface of the door; and a manipulation member engaging the guide portion and slidable along the guide portion between a first position and a second position, wherein the drawer is coupled to the door when the manipulation member is in the first position and uncoupled from the door when the manipulation member is in the second position, and wherein an upper surface of the drawer comprises:

a top surface including a depression area having a first surface lower than the top surface;

a pair of inclined surfaces between the top surface and the first surface; and a hook jaw between the inclined surfaces and next to the depression area.

4. The refrigerator of claim 3, wherein the manipulation member comprises:

a body; and a projection biased downwardly from a bottom surface of the body, the projection being in a downward position when the manipulation member is in the first position, the first position being over the depression area and the projection moved upwardly when the manipulation member is in the second position, the second position being over one of the inclined surfaces.

5. The refrigerator of claim 4, wherein the projection engages the hook jaw when the manipulation member is in the first position and does not engage the hook jaw when the manipulation member is in the second position.

6. The refrigerator of claim 1, wherein the cooling compartment is a freezer compartment.

7. The refrigerator of claim 1, further comprising a second drawer disposed in the cooling compartment and coupled to the door.

* * * * *